US011904913B2

(12) United States Patent
Piparsaniya

(10) Patent No.: US 11,904,913 B2
(45) Date of Patent: Feb. 20, 2024

(54) AUDIO-BASED MANAGEMENT OF EQUIPMENT ONBOARD A TRAIN

(71) Applicant: Siemens Mobility, Inc., New York, NY (US)

(72) Inventor: Harsh Piparsaniya, Pune (IN)

(73) Assignee: Siemens Mobility, Inc., New York, NY (US)

( * ) Notice: Subject to any disclaimer, the term of this patent is extended or adjusted under 35 U.S.C. 154(b) by 579 days.

(21) Appl. No.: 17/038,288

(22) Filed: Sep. 30, 2020

(65) Prior Publication Data

US 2022/0097744 A1 Mar. 31, 2022

(51) Int. Cl.
*B61L 15/00* (2006.01)

(52) U.S. Cl.
CPC ..... *B61L 15/0081* (2013.01); *B61L 15/009* (2013.01); *B61L 15/0054* (2013.01)

(58) Field of Classification Search
CPC ..... B61L 15/0081; B61L 15/0054; B61L 15/009; B61L 15/0027
See application file for complete search history.

(56) References Cited

U.S. PATENT DOCUMENTS

2008/0208401 A1* 8/2008 Kumar ..... B61L 3/006 701/19
2014/0066132 A1* 3/2014 Burke ..... H04L 67/12 455/569.2
2017/0096154 A1* 4/2017 Hurst ..... G09B 9/04
2017/0253258 A1* 9/2017 Bramucci ..... B61L 15/0054
2018/0084055 A1* 3/2018 Mong ..... B61L 23/005
2019/0217875 A1* 7/2019 Ito ..... B61L 27/20
2019/0322298 A1* 10/2019 Mong ..... B61L 23/005
2020/0001906 A1* 1/2020 Bramucci ..... B61L 15/0072
2020/0382338 A1* 12/2020 Siergiej ..... H04L 12/10

OTHER PUBLICATIONS

Saito et al, A., Method for Selecting Appropriate Sounds to Convey Alerts to Train Drivers, Google Scholar, Quarterly Report of the RTRI, vol. 58, No. 2, May 2017, pp. 139-144. (Year: 2017).*

* cited by examiner

*Primary Examiner* — Russell Frejd
(74) *Attorney, Agent, or Firm* — Lempia Summerfield Katz LLC

(57) ABSTRACT

A Head-of-Train device suitable for mounting inside a cab of a train is disclosed. The Head-of-Train device includes a memory and a processing unit communicatively coupled to the memory, wherein the processing unit is configured to execute one or more instructions in the memory to synthesize an audio message based on status associated with at least one equipment onboard the train. The Head-of Train device further includes an audio output device configured to output the audio message.

16 Claims, 4 Drawing Sheets

200 System for audio-based management of equipment
210 EOT device
215 HOT device
220 Telemetry link
225 Processing unit
230 Memory
235 Communication unit
240 Audio message generation module
245 Audio input processing module
250 Instruction generation module 100 HOT device
105 Front panel
110 Enclosure
115A, B, C Digital displays
120A, B, C LED indicators
125A, B, C Push buttons
130 Key pad
135 Guarded emergency switch
140 Audio output device
145 Audio input device 200 System for audio-based management of equipment
210 EOT device
215 HOT device
220 Telemetry link
225 Processing unit
230 Memory
235 Communication unit
240 Audio message generation module
245 Audio input processing module
250 Instruction generation module

AUDIO-BASED MANAGEMENT OF EQUIPMENT ONBOARD A TRAIN

TECHNICAL FIELD

The present disclosure relates to a field of rail automation, and in particular to a Head-of-Train device, system, and method for audio-based management of equipment onboard a train.

BACKGROUND

At present, locomotive operators visually monitor a plurality of dials and digital displays for checking if onboard equipment are working properly. Head-of-Train devices are used for providing visual indications for different statuses received from an End-of-Train device. The parameters may be related to, for example, brake pipe pressure, movement of the train, marker light, and emergency valve. However, failure to notice the visual indications may lead to mishaps. For example, if the locomotive operator proceeds to apply emergency brakes without paying attention to a pressure failure, critical damages may occur. Further to the above, hardware of the Head-of-Train device has to be upgraded with changes in features of the End-of-Train device, in order to accommodate visual indications corresponding to the additional features of the End-of-Train device. In light of the above, there exists a need for an improved mechanism for monitoring and managing onboard equipment.

BRIEF SUMMARY

The scope of the present disclosure is defined solely by the appended claims and is not affected to any degree by the statements within this summary. The present embodiments may obviate one or more of the drawbacks or limitations in the related art.

Aspects of the present disclosure relate to audio-based management of equipment onboard a train. In one aspect a Head-of-Train device suitable for mounting inside a cab of a train is disclosed. The Head-of-Train device includes a memory and a processing unit communicatively coupled to the memory. The processing unit is configured to execute one or more instructions in the memory to generate an audio message based on status associated with at least one equipment onboard the train, wherein the status includes at least one of an operational parameter measured by the equipment and an operational state of the equipment. The Head-of-Train device further includes an audio output device configured to output the audio message. In an embodiment, the Head-of-Train device further includes an audio input device configured to receive an audio input from a locomotive operator of the train. In a further embodiment, the processing unit is configured to initiate execution of one or more actions based on the audio input received from the locomotive operator. A train including a Head-of-Train device as described above is also disclosed.

In another aspect, a system for audio-based management of equipment onboard the train is disclosed. The system includes a first subsystem configured via executable instructions to monitor status associated with at least one equipment onboard the train, wherein the status includes at least one of an operational parameter measured by the equipment and an operational state of the equipment. The first subsystem is further configured to generate a status message based on the status associated with the equipment. The system further includes a second subsystem communicatively coupled to the first subsystem. The second subsystem is configured via executable instructions to receive a status message corresponding to the status associated with the equipment from the first subsystem, configure a text based on a type of the status message received, synthesize an audio message based on the configured text, and output the audio message via an audio output device. The second subsystem is further configured to receive an audio input from a locomotive operator of the train in response to the audio message, analyze the audio input to determine one or more actions to be performed at the equipment, generate one or more instructions for performing the one or more actions on the equipment, and transmit the one or more instructions to another subsystem for execution. In an embodiment, the first subsystem is an End-of-Train device. In an embodiment, the second subsystem is a Head-of-Train device.

In yet another aspect, a method for audio-based management of equipment onboard the train is disclosed. The method includes receiving, by a processing unit, a status message corresponding to status associated with at least one equipment onboard the train, wherein the status includes at least one of an operational parameter measured by the equipment and an operational state of the equipment. The method further includes configuring a text based on a type of the status message received. The method further includes synthesizing an audio message based on the configured text. The method further includes output the audio message via an audio output device. In an embodiment, the method further includes receiving an audio input from the locomotive operator of the train in response to the audio message, analyzing the audio input to determine one or more actions to be performed at the equipment, and generating one or more instructions for performing the one or more actions on the equipment.

BRIEF DESCRIPTION OF THE FIGURES

The present disclosure is further described hereinafter with reference to illustrated embodiments shown in the accompanying drawings, in which.

DETAILED DESCRIPTION

Figure 1:
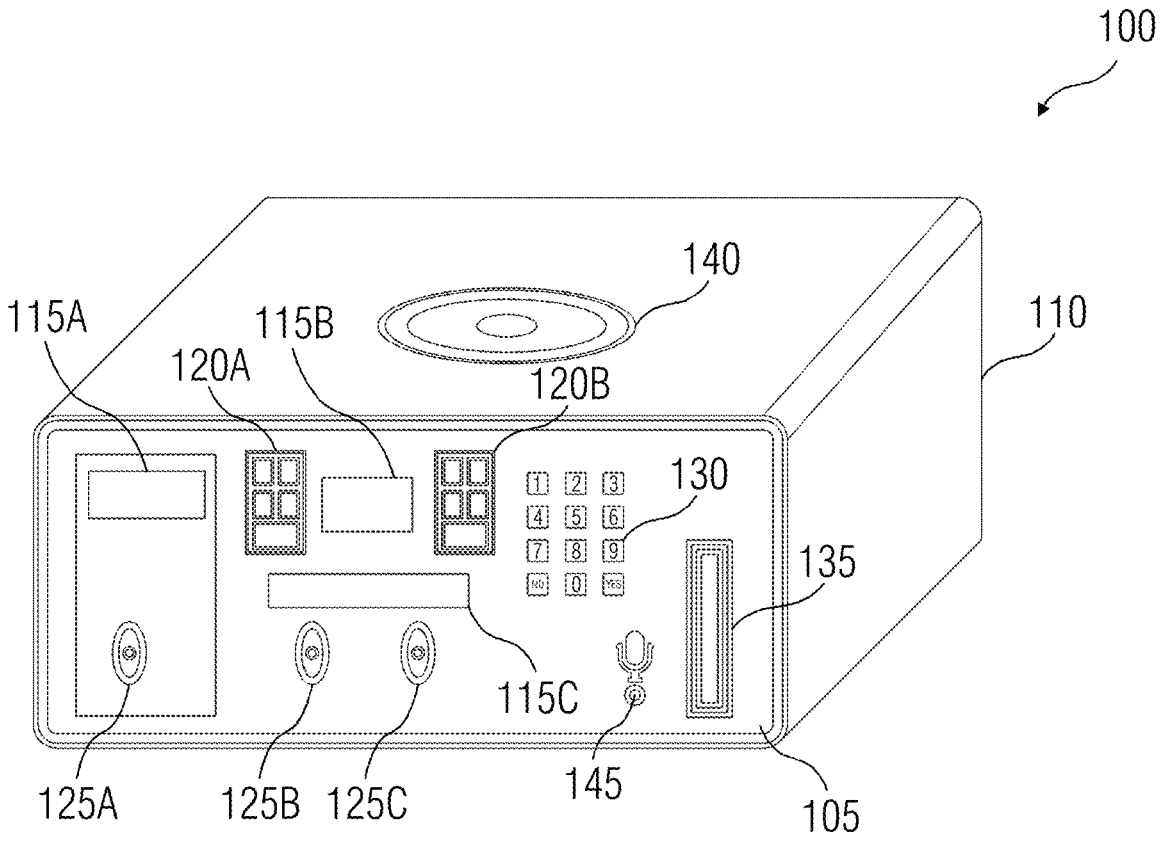
FIG. 1 is a schematic view of a Head-of-Train device suitable for mounting in a cab of a train, in accordance with an exemplary embodiment.

Various embodiments are described with reference to the drawings, where like reference numerals are used in reference to the drawings. Like reference numerals are used to refer to like elements throughout. In the following description, numerous specific details are set forth in order to provide a thorough understanding of embodiments. These specific details need not be employed to practice embodiments. In other instances, well known materials or methods have not been described in detail in order to avoid unnecessarily obscuring embodiments. While the disclosure is susceptible to various modifications and alternative forms, specific embodiments thereof are shown by way of example in the drawings and will herein be described in detail. There is no intent to limit the disclosure to the particular forms disclosed. Instead, the disclosure is to cover all modifications, equivalents, and alternatives falling within the scope of the present disclosure.

FIG. 1 is a schematic view of a Head-of-Train (HOT) device 100 suitable for mounting in a cab of a train, in accordance with an exemplary embodiment. The HOT device 100 includes a front panel 105 and an enclosure 110. The front panel 105 includes a plurality of digital displays 115A, 115B, and 115C, a plurality of LED indicators 120A and 120B, a plurality of push buttons 125A, 125B, and 125C and a 12-digit keypad 130.

The digital display 115A indicates an acceleration of the train computed based on a wheel diameter of the train and an odometer data associated with the train. The digital display 115A may also indicate the distance covered by the train. The push button 125A enables a locomotive operator to switch between readings for acceleration and distance on the digital display 115A. The digital display 115B indicates brake pipe pressure based on brake pipe pressure values received from the EOT device. The push button 125C is used for testing communication between the HOT device 100 and an End-of-Train (EOT) device (not shown) communicatively coupled to the HOT device 100, and also for arming the HOT device 100. The digital display 115C indicates a status of communication between the HOT device 100 and the EOT device, when the locomotive operator presses the push button 125C. The digital display 115B is also configured to prompt the locomotive operator to input parameters such as, but not limited to, a marker identification number, wheel size settings, and axle drive type configuration. The locomotive operator may input the values using the keypad 130. The push button 125B enables the locomotive operator to navigate through a settings menu associated with the HOT device 100. The LED indicators 120A and 120B visually indicate status related to motion of the train, marker light, communication, and the like. The HOT device 100 further includes a guarded emergency switch 135. The locomotive operator may pull the emergency switch in order to send a request for adjusting brake pressure to the EOT device in case of emergency. The enclosure 110 houses electronic circuitry necessary for operation of the HOT device 100. The electronic circuitry includes, for example, display circuits, processing units, memory devices, event recorders, communication units, and the like. A person having ordinary skill in the art is familiar with structure, components, and functions of different types of HOT devices, and therefore, these aspects will not be described in further detail herein.

The HOT device 100 further includes an audio output device 140. In the present embodiment, the audio output device is a dynamic loudspeaker. In another embodiment, the HOT device 100 may include a provision for connecting a headphone that may be worn by the locomotive operator. The HOT device 100 further includes an audio input device 145. In an embodiment, the audio input device is a microphone. In another embodiment, the HOT device 100 may include a provision for plugging a microphone to the HOT device 100. The HOT device 100 may be installed in a cab of the train as one of a console unit and a standalone unit.

Figure 2:
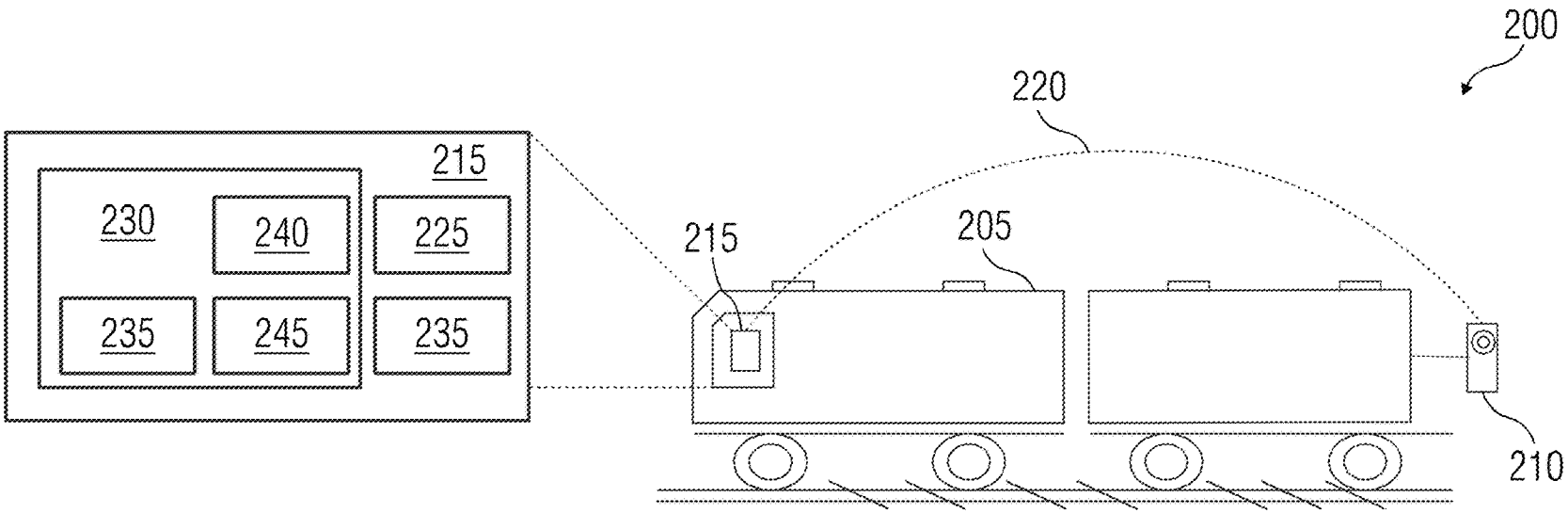
FIG. 2 illustrates a system for audio-based management of equipment onboard the train, in accordance with an embodiment.

FIG. 2 illustrates a system 200 for audio-based management of equipment onboard a train 205, in accordance with an embodiment. The system 200 includes a first subsystem and a second subsystem communicatively coupled to each other. In the present embodiment, the first subsystem is an EOT device 210 and the second subsystem is the HOT device 215, similar to the HOT device 100. The EOT device 210 and the HOT device 215 are communicatively coupled to each other over a telemetry link 220 to form an End-of-Train Telemetry (EOTT) system. The HOT device 215 is mounted in a cab of the train 205 and the EOT device 210 is mounted at a rear-end of the train 205.

The EOT device 210 includes an air generator and a motion tracking device. The air generator is configured to charge a battery associated with the EOT device 210. The motion tracking device includes at least one of a GPS receiver and an accelerometer configured to detect motion of the train 205. The EOT device 210 further includes a storage unit configured to store events. The events may be associated with, for example, change in the operational state of the EOT device 210 or equipment associated with the EOT device 210. In an embodiment, the storage unit is a Secure Digital (SD) card. In addition to the above, the EOT device 210 further includes other components such as High Visibility Marker (HVM) and a Sensing and Braking Unit (SBU). The HVM may include high intensity LED arrays that provides a visible indication of the presence of the train 205 to following trains. The SBU includes a brake pipe sensing hose for monitoring brake line pressure and an air braking system for controlling the brake lines. The EOT device 210 further includes other components such as cell phone transceivers and communication systems for communicating with other units including the HOT device 215. A person having ordinary skill in the art is familiar with structure, components, and functions of different types of EOT devices, and therefore, these aspects will not be described in further detail herein.

The HOT device 215 further includes a processing unit 225, a memory 230, and a communication unit 235. The processing unit 225 may include any type of computational circuit, such as, but not limited to, a microprocessor, microcontroller, application specific integrated circuits, single-chip computers, and the like. The memory 230 may include one or more of a volatile memory and a non-volatile memory. The memory 230 may be coupled for communication with the processing unit 225. The processing unit 225 may execute instructions and/or code stored in the first memory 230. The memory 230 may include any suitable elements for storing data and machine-readable instructions, such as read only memory, random access memory, erasable programmable read only memory, electrically erasable programmable read only memory, hard drive, removable media drive for handling compact disks, digital video disks, diskettes, magnetic tape cartridges, memory cards, and the like. The memory 230 includes machine-readable instructions which when executed by the processing unit 225 causes the processing unit 225 to generate audio messages based on status associated with at least one equipment onboard the train 205. In addition, the machine-readable instructions further enable the HOT device 215 to process audio inputs from a locomotive operator of the train 205 for performing one or more actions at the equipment. In the present embodiment, the memory 230 includes an audio message generation module 240, an audio input processing module 245, and an instruction generation module 250.

The audio message generation module 240 is configured to receive status messages corresponding to status associated with at least one equipment onboard the train 205. The status includes at least one of an operational parameter measured or sensed by the equipment and an operational state of the equipment. The operational parameters include, but are not limited to, brake line pressure, motion, acceleration, voltage, speed, and distance. The operational state of the equipment indicates a mode of operation of the equipment. For example, the operational state may be one of ON, OFF, or standby. Further, a text is configured based on a type of the status message. Further, an audio message is synthesized based on the configured text. The audio message is further outputted through an audio output device associated with the HOT device 215. The audio input processing module 245 is configured to receive an audio input from the locomotive operator in response to the audio message. The audio input processing module 245 is further configured to analyze the audio input to determine one or more actions to be performed at the equipment. The instruction generation module 250 is configured to generate one or more instructions for performing the one or more actions on the equipment. The communication unit 235 further transmits the one or more instructions to another subsystem for execution. The term 'another subsystem' as used herein may refer to the EOT device 210 or a control unit associated with one or more onboard equipment capable of performing the one or more actions.

In addition to the above, the HOT device 215 further includes a storage unit (not shown) including a local database. The storage unit may include, but is not limited to, storage disks, Secure Digital (SD) cards, and external flash memory. The local database may store templates for text, pre-recorded sounds, and recommendations corresponding to different statuses associated with a plurality of equipment.

Figure 3:
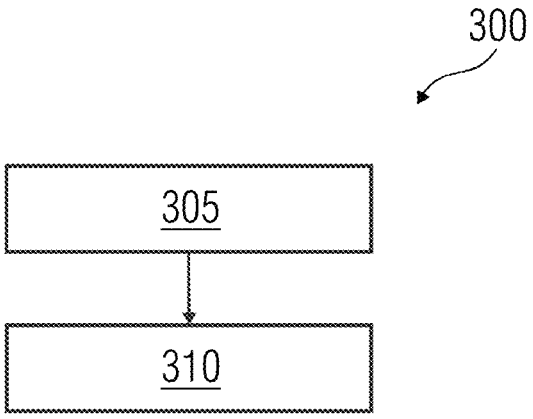
FIG. 3 depicts a flowchart of an exemplary method for generating status messages at an End-of-Train device, in accordance with an embodiment.

FIG. 3 depicts a flowchart of an exemplary method 300 for generating status messages at the EOT device 210, in accordance with an embodiment.

At act 305, status of at least one equipment on the train 205 is monitored by the EOT device 210. The equipment may include, but is not limited to, the EOT device 210, the HVM, the battery, the motion tracking device, the SBU, the air generator, and radio equipment including Wi-Fi equipment at the EOT device 210. For example, if power of a battery connected to the HVM is less than a threshold value, a failure of the HVM is detected. Therefore, the EOT device 210 may monitor the power to determine the status of the HVM. In another example, if a rotational speed or voltage output of the air generator is less than a predefined threshold, failure of the air generator is detected. In yet another example, if the communication between the EOT device 210 and the HOT device 215 fails during a communication test, a failure of the radio equipment is detected.

At act 310, the EOT device 210 transmits the status of the equipment to the HOT device 215. The status is transmitted in the form of a status message. The status message is constructed by the EOT device 210 based on a set of instructions stored in a memory (not shown) of the EOT device 210. The status message may indicate a mode of notification, the equipment, and the status. The mode of notification may be one of audio notification and visual notification. In an implementation, the status message may be a string of alphanumeric characters that includes a type identifier, equipment identifier, and status identifier. However, the status message may be configured in any format. For example, the status message may be in binary format. The type identifier indicates the format in which the status is to be notified to the locomotive operator. In an example, presence of a type identifier 'A' in the status message indicates that status is to be notified to the locomotive operator as a high priority message. On the contrary, type identifier 'V' indicates that the status is to be notified through visual indications on the HOT device 215 because of low priority. Similarly, absence of a type identifier may also indicate that the status is to be notified through visual indications on the HOT device 215.

The equipment identifier indicates the equipment for which the status is being notified. For example, the equipment identifier HVM represents a high visibility marker, GEN represents a generator, and GVLV represents a generator disable valve. The status identifier indicates a status of the equipment. The status is associated with an operation of the of the at least one equipment. In an example, the status may indicate failure of equipment such as, but not limited to, generator, HVM, and SBU. In another example, the status may indicate degradation in health of equipment such as, but not limited to, the battery and the air generator. For example, the status identifier 'N' indicates that the equipment is not performing an intended function. The status identifier may also include values of operating parameters associated with the equipment. In addition, the status message may further indicate the number of times an audio message must be repeated. For example, the status message may be 'A/HVM/N/2'. Here, A is the type identifier of the status message indicating that the status has to be notified in audio format, HVM is the equipment identifier indicating that the equipment is the HVM, and N is the status identifier indicating that the HVM is not performing the intended function. The number '2' indicates that the audio message must be played two times. The default mode of notification may be visual notifications. For example, the status message may be WIFI/N which indicates that the Wi-Fi is not performing an intended function. As there is no type identifier, the status message is to be provided as a visual indication on the HOT device 215.

The status message is further modulated onto a carrier signal using a modulation technique. The frequency of the carrier signal may be a radio frequency specific to communications in a railway network of a region. For example, in the United States, the radio frequency range of 400-470 MHz may be used. However, any suitable frequency may be selected for the purpose of sending such status messages. Non-limiting examples of modulation techniques include amplitude modulation, frequency modulation, phase modulation, phase shift keying, and pulse code modulation. In an embodiment, the status message is generated in binary format. Further, a square-pulse waveform is generated from the status message in binary format. The modulated signal is further amplified and transmitted to the HOT device 215 as a radio signal at a predefined channel frequency over the telemetry link 220.

Figure 4:
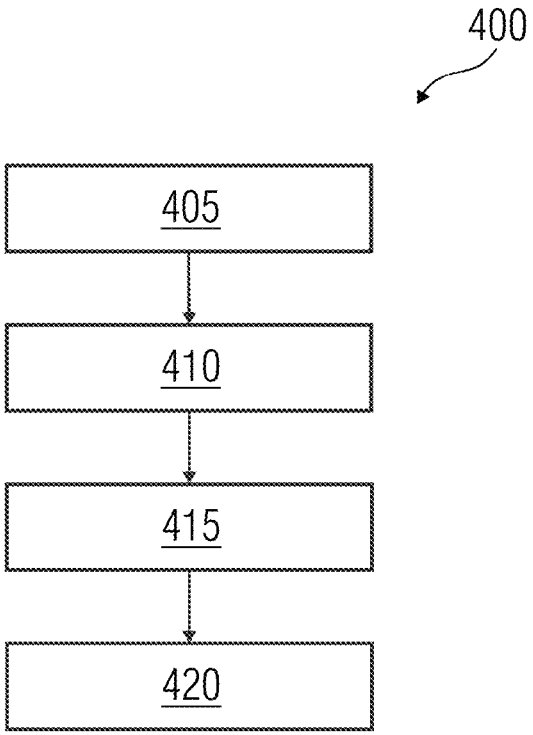
FIG. 4 depicts a flowchart of a method for managing operation of the train, in accordance with an embodiment.

FIG. 4 depicts a flowchart of a method 400 for managing operation of the train 205, in accordance with an embodiment. At act 405, a status message corresponding to status of at least one equipment onboard the train 205 is received. In the present embodiment, the status message is received as the radio signal from the EOT device 210. The radio signal is demodulated at the HOT device 215 using suitable demodulation techniques, to obtain the status message.

At act 410, a text is configured based on a type of the status message received. More specifically, the HOT device 215 checks whether a type identifier is present in the status message. If a type identifier corresponding to audio notification is present, the text is configured based on the equipment identifier and the status identifier present in the message. In an embodiment, the local database stores a plurality of templates for the text. For example, the local database stores templates corresponding to each status of the equipment. The template is selected from the plurality of templates based on the equipment identifier, the status identifier, and one or more predefined settings. The predefined settings may correspond to settings that enhance an effectiveness of the audio message, for example, a language to be used for the audio message. In an example, the language may be preconfigured by an Original Equipment Manufacturer of the HOT device 215. In another example, the language may be selected by the locomotive operator through the settings menu on the HOT device 215. For example, if the status message is A/GEN/N, the text may be configured as "Generator malfunctioning detected". Otherwise, if the status message is A/HVM/N/2, the text in English may be configured as "Marker malfunctioning detected". In an implementation, the status message the template is suitably modified to include variable parameter values associated with the equipment. For example, the status message may be "Brake line pressure is 65 psi".

In an embodiment, the audio message further includes one or more recommendations based on the status of the equipment. The recommendations correspond to mitigating a risk associated with the operation of the train 205. For example, if the status indicates that the brake line pressure is low, the recommendation may be 'Brake pressure low. Do not apply emergency brake'. The recommendations are generated by the HOT device 215 based on a predefined logic stored in the memory 230. The predefined logic maps the status of the equipment to one or more recommendations stored in the form of text in the local database. Any suitable mapping logic may be used to map the status associated with the equipment to the recommendations stored. For example, encoded text corresponding to the status may be used to search for the recommendations from the local database.

In another embodiment, the HOT device 215 transmits the status message to a central server (not shown). The central server may be a real or a virtual group of computers. The central server analyzes the status message to determine the risk associated with the equipment. For example, malfunctioning of the air generator results in improper charging of the battery of the EOT device 210. In another example, malfunction of the Wi-Fi results in communication failure. In yet another example, malfunction of the HVM may lead to lack of visibility at the rear-end of the train 205. In an implementation, predictive analytics is used to determine the risk from the status. The risk may be classified as one of low, medium, and high. The predictive analytics is performed based on operating parameter values and statuses associated with the equipment. For example, historic data associated with the equipment is analyzed to determine a trend associated with an operating parameter of the equipment. The trend may be further extrapolated to determine the risk. The predictive analytics is performed based on techniques including, but not limited to, machine learning, artificial intelligence, statistics, data mining, and data modeling. Based on the risk determined, the central server identifies one or more recommendations for mitigating the risk. The one or more recommendations are identified based on a plurality of recommendations present in a database associated with the server. In case the determined risk is classified as high, the central server may additionally transmit a notification indicating the status to an Operator Control System geographically closest to the train 205. The central server may also transmit the notification to an electronic device associated with a railway authority for immediate action.

At act 415, an audio message is synthesized based on the configured text. In an embodiment, the text is converted to the audio message using a text-to-speech engine. The text-to-speech engine breaks down the text into individual words. Further, a sequence of phonemes present in each of the words are identified. The term 'phonemes' as used herein refers to a unit of sound in speech. In an embodiment, the phonemes are identified based on pre-recorded sounds stored in the storage unit. More specifically, a phoneme is compared to the pre-recorded sounds in order to identify the phoneme. Upon generating the sequence of phonemes, the audio message is synthesized by concatenating the phonemes.

At act 420, the audio message is outputted via an audio output device. More specifically, the audio message is played through the speaker. The audio message is repeated based on the number of repetitions specified in the status message. For example, if the status message is A/HVM/N/2, the audio message is repeated two times. In another example, if the status message is A/GEN/N, the audio message is played once. In a further embodiment, the locomotive operator may acknowledge the audio message by pressing a push button on the HOT device 215 or by providing an audio input to the HOT device 215.

Figure 5:
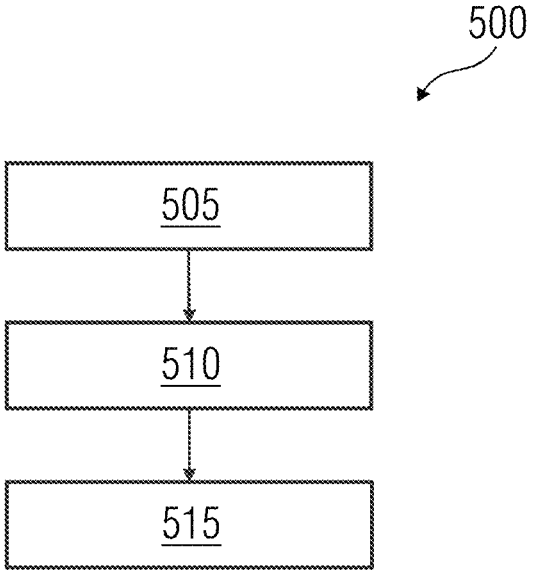
FIG. 5 depicts a flowchart of a method for managing operation of equipment based on audio inputs received from a locomotive operator, in accordance with an embodiment.

FIG. 5 depicts a flowchart of a method 500 for managing operation of equipment based on audio inputs received from the locomotive operator, in accordance with an embodiment.

At act 505, an audio input is received from the locomotive operator of the train 205 in response to the audio message. In the present embodiment, the audio input is the microphone. Here, the audio input is a voice command provided in response to the audio message. In certain examples, the audio input provided to the HOT device 215 may not be in response to the audio message. For example, the locomotive operator may provide instructions to an onboard equipment by providing an audio input specifying the instruction, to the HOT device 215. The instruction may correspond to checking status of an equipment or for adjusting a parameter associated with the equipment. For example, the audio input is of the form, 'Adjust rear pressure to 120 psi', 'Check HVM status' or 'Apply emergency brakes'.

At act 510, the audio input is analyzed to determine one or more actions to be performed at the equipment. The audio input is filtered to remove background noise. In an embodiment, the HOT device 215 is provided with hardware-based filters for filtering out the background noise. Upon filtering, the audio input in analog form is converted to a digital form using an analog to digital converter provided in the HOT device 215. The audio input in digital form is further preprocessed to adjust volume and temporal alignment of the audio input based on predefined settings. The preprocessed audio input is further analyzed to identify a sequence of phonemes present in the audio input. In an embodiment, a statistical model is used to identify the sequence of phonemes. The identified sequence of phonemes are further compared to a library of audio commands stored in the local database. If a matching audio command is identified from the library, one or more actions corresponding to the audio command are determined. The one or more actions corresponding to the audio command are stored in the local database.

At act 515, one or more instructions for performing the one or more actions on the equipment are generated. In an implementation, the one or more instructions are generated in a machine-readable format. In an embodiment, the one or more instructions corresponding to the one or more actions are readily stored in the memory 230 of the HOT device 215. The HOT device 215 executes the one or more instructions for performing the one or more actions specified through the audio command. In another embodiment, the one or more instructions are transmitted to the EOT device 210 for execution. The EOT device 210 may further adjust operating parameters associated with the equipment in order to perform the action. For example, if the audio command is 'Adjust rear pressure to 120 psi', the EOT device 210 adjusts the air pressure in the brake pipes to 120 psi. In another example, if the audio command is 'Check HVM status', the EOT device 210 transmits an operational state of the HVM to the HOT device 215 as a status message. The HOT device 215 further generates an audio message based on the status of the HVM, as explained earlier using method 400.

Advantageously, the present disclosure enables a HOT device to generate audio-based alerts. As a result, the chances of the locomotive operator missing critical statuses is reduced. Furthermore, the hardware of the HOT device need not be updated for changes in the features of the EOT device. The present disclosure also enables the HOT device to receive audio-based commands for performing an action.

While embodiments of the present disclosure have been disclosed in exemplary forms, it will be apparent to those skilled in the art that many modifications, additions, and deletions may be made therein without departing from the spirit and scope of the disclosure and its equivalents, as set forth in the following claims. It is therefore intended that the foregoing description be regarded as illustrative rather than limiting, and that it be understood that all equivalents and/or combinations of embodiments are intended to be included in this description.

It is to be understood that the elements and features recited in the appended claims may be combined in different ways to produce new claims that likewise fall within the scope of the present disclosure. Thus, whereas the dependent claims appended below depend from only a single independent or dependent claim, it is to be understood that these dependent claims may, alternatively, be made to depend in the alternative from any preceding or following claim, whether independent or dependent, and that such new combinations are to be understood as forming a part of the present specification.

The invention claimed is:

1. A Head-of-Train device suitable for mounting inside a cab of a train, the Head-of-Train device comprising:

a memory;

a processing unit communicatively coupled to the memory, wherein the processing unit is configured to:

receive a status message based on a status associated with at least one equipment onboard the train, wherein the status comprises at least one of an operational parameter measured by the at least one equipment and an operational state of the at least one equipment, and wherein the status message comprises a type identifier, an equipment identifier, and a status identifier;

configure a text by selecting a template from a plurality of templates based on the equipment identifier of the status message, the status identifier of the status message, and one or more predefined settings; and execute one or more instructions in the memory to synthesize an audio message by converting the configured text to audio using a text-to-speech engine; and an audio output device configured to output the audio message.

2. The Head-of-Train device of claim 1, further comprising:

an audio input device configured to receive an audio input from a locomotive operator of the train.

3. The Head-of-Train device of claim 2, wherein the processing unit is configured to initiate execution of one or more actions based on the audio input received from the locomotive operator.

4. A train comprising:

a Head-of-Train device having:

a memory;

a processing unit communicatively coupled to the memory, wherein the processing unit is configured to:

receive a status message based on a status associated with at least one equipment onboard the train, wherein the status comprises at least one of an operational parameter measured by the at least one equipment and an operational state of the at least one equipment, and wherein the status message comprises a type identifier of the status message, an equipment identifier of the status message, and a status identifier;

configure a text by selecting a template from a plurality of templates based on the equipment identifier, the status identifier, and one or more predefined settings; and execute one or more instructions in the memory to synthesize an audio message by converting the configured text to audio using a text-to-speech engine; and an audio output device configured to output the audio message.

5. A system comprising:

a first subsystem configured via executable instructions to:

monitor a status associated with at least one equipment onboard a train, wherein the status comprises at least one of an operational parameter measured by the at least one equipment and an operational state of the at least one equipment; and generate a status message based on the status associated with the at least one equipment, wherein the status message comprises a type identifier, an equipment identifier, and a status identifier; and a second subsystem communicatively coupled to the first subsystem, wherein the second subsystem is configured via executable instructions to:

receive the status message corresponding to the status associated with the at least one equipment from the first subsystem;

configure a text based on a type of the status message received by selecting a template from a plurality of templates based on the equipment identifier of the status message, the status identifier of the status message, and one or more predefined settings;

synthesize an audio message by converting the configured text to audio using a text-to-speech engine; and output the audio message via an audio output device.

6. The system of claim 5, wherein the second subsystem is further configured to:

receive an audio input from a locomotive operator of the train in response to the audio message;

analyze the audio input to determine one or more actions to be performed at the at least one equipment; and generate one or more instructions for performing the one or more actions on the at least one equipment.

7. The system of claim 6, wherein the second subsystem is further configured to:

transmit the one or more instructions to another subsystem for execution.

8. The system of claim 5, wherein the first subsystem is an End-of-Train device.

9. The system of claim 5, wherein the second subsystem is a Head-of-Train device.

10. A method comprising:

receiving, by a processing unit, a status message corresponding to a status associated with at least one equipment onboard a train, wherein the status comprises at least one of an operational parameter measured by the at least one equipment and an operational state of the at least one equipment, and wherein the status message comprises a type identifier, an equipment identifier, and a status identifier;

configuring a text based on a type of the status message received by selecting a template from a plurality of templates based on the equipment identifier of the status message, the status identifier of the status message, and one or more predefined settings;

synthesizing an audio message by converting the configured text to audio using a text-to-speech engine; and output the audio message via an audio output device.

11. The method of claim 10, wherein the configuring of the text further comprises:

determining one or more recommendations based on the type of the status message; and configuring the text based on the one or more recommendations.

12. The method of claim 11, wherein the one or more recommendations correspond to actions for mitigating a risk associated with operation of the train.

13. The method of claim 11, wherein the one or more recommendations are determined based on a predefined logic.

14. The method of claim 11, wherein the determining of the one or more recommendations comprises:

transmitting the status message to a central server for generating the one or more recommendations based on an analysis of the status message; and receiving the one or more recommendations from the central server.

15. The method of claim 10, further comprising:

receiving an audio input from a locomotive operator of the train in response to the audio message;

analyzing the audio input to determine one or more actions to be performed at the at least one equipment; and generating one or more instructions for performing the one or more actions on the at least one equipment.

16. The method of claim 15, further comprising:

transmitting the one or more instructions to another subsystem for performing the one or more actions.

* * * * *